US006361252B1

(12) United States Patent
Leitheiser

(10) Patent No.: US 6,361,252 B1
(45) Date of Patent: Mar. 26, 2002

(54) DOCK SUPPORT AND HEIGHT ADJUSTMENT APPARATUS

(75) Inventor: Larry Allen Leitheiser, Detroit Lakes, MN (US)

(73) Assignee: Bob's Machine & Manufacturing, Inc., Detroit Lakes, MN (US)

( * ) Notice: Subject to any disclaimer, the term of this patent is extended or adjusted under 35 U.S.C. 154(b) by 0 days.

(21) Appl. No.: 09/775,030

(22) Filed: Feb. 1, 2001

(51) Int. Cl.[7] ..... E02B 3/20

(52) U.S. Cl. ..... 405/221; 405/196; 405/218; 16/33

(58) Field of Search ..... 405/221, 3, 220, 405/218, 195.1, 196; 16/32, 33, 35 R, 42 R; 14/24

(56) References Cited

U.S. PATENT DOCUMENTS 1,975,049 A * 9/1934 Middlebrook
2,687,617 A * 8/1954 Newell
3,034,162 A * 5/1962 Smith
3,121,556 A * 2/1964 Faulkner
3,169,644 A 2/1965 Godbersen
3,380,257 A 4/1968 Gillman et al.
3,824,796 A * 7/1974 Nasby, Jr.
4,505,619 A 3/1985 Sargent
4,930,937 A * 6/1990 Fulton
5,238,324 A * 8/1993 Dettling, Jr.
5,562,362 A * 10/1996 Vezner

* cited by examiner

*Primary Examiner*—David Bagnell
*Assistant Examiner*—Katherine Mitchell
(74) *Attorney, Agent, or Firm*—Moore & Hansen

(57) ABSTRACT

A dock for supporting persons over a support surface such as a water bed has an elongated deck, a plurality of vertically adjustable post units, and a wheel attached to each post unit for transporting the dock across the support surface. The vertically adjustable post units are secured to the deck at spaced-apart locations and include a first elongated post section connected to the deck, a second elongated post section vertically movable with respect to the first elongated post section, and a base pad connected to the second elongated post section. A wheel assembly supporting a rotatable wheel is rigidly connected to the first elongated post section. The post units are adjustable to a transport position in which the base pad is off the support surface and the wheel is on the support surface. The vertically adjustable post unit is also adjustable to an operating position in which the base pad is on the support surface and the wheel is off the support surface for stabilizing the dock.

12 Claims, 2 Drawing Sheets

DOCK SUPPORT AND HEIGHT ADJUSTMENT APPARATUS

BACKGROUND OF THE INVENTION

The present invention generally relates to dock structures wherein the height of the mooring platform can be varied with respect to the bed of the body of water. More particularly, the invention is concerned with dock structures provided with wheels mounted on posts for supporting persons over a support surface such as a water bed.

It is known to provide dock sections with wheels to facilitate the rolling movement of such docks into position in lakes and rivers. One such portable dock is described in U.S. Pat. No. 3,380,257 to R. Gillman, et al. The Gillman patent discloses a portable dock having a reinforced support structure on which is mounted wheel supports. The wheel supports are relatively moveable by sleeves moved by a pulley and cable system operated from a remote winch. U.S. Pat. No. 5,238,324 to Dettling, Jr. discloses a wheeled boat dock. The boat dock and lift comprise a pair of wing decks hingedly attached to a main deck. The wing decks may be folded for transportation and the lift is vertically adjustable with a jack screw means to provide a level surface relative to the main deck to provide a level walking surface.

A significant drawback to the use of wheels as the sole support for the outer end docks is that it renders the docks subject to sway, thus making them unstable. There is always some play between the wheel axles and the wheel bushing in which the axles are mounted, thus permitting some sway of the dock sections. Consequently, a need exists for improvements in wheel docks which will result in greater stability in their operating position.

BRIEF SUMMARY OF THE INVENTION

In order to overcome this instability problem, the present invention provides a portable dock having a plurality of vertically adjustable post units in combination with wheels. In the operating position of the portable dock, a base pad connected to each post unit contacts the water bed support surface while the wheels are suspended above the support surface. The portable dock structure now has greater stability and less sway since the post units and base pads support the deck instead of the wheels.

Accordingly, the present invention relates to a dock for supporting persons over a support surface comprising an elongated deck and a plurality of vertically adjusted post units secured to the deck at spaced-apart locations thereon for varying the height of the deck with respect to the support surface. Each of the post units include a first elongated post section connected to the deck, a second elongated post section vertically movable with respect to the first elongated post section, a base pad connected to the second elongated post section, and a wheel rotatably connected to the first elongated post section of the post unit for transporting the dock across the support surface.

The portable dock can be adjusted by the vertically adjustable post units into an operating or transport position. The vertically adjustable post unit is adjustable to a transport position wherein the base pad is off the support surface and the wheel is on the support surface for transporting the dock. Also, the vertically adjustable post unit is adjustable to an operating position in which the base pad is on a support surface and the wheel is off the support surface for stabilizing the dock.

The post unit wheels may advantageously be part of a wheel assembly comprising an axle/shaft having a mounting bracket at one end. The wheel has a hub that defines a bore for the axle. The axle has one end disposed within the hub of the wheel and the axle has an opposite end to which the bracket is attached. The bracket of each wheel assembly is rigidly connected to the first elongated post section of each post unit.

In one preferred embodiment, the wheels are disposed laterally outwardly from the first elongated post section of each post unit. In another preferred embodiment, the wheels are disposed laterally inwardly from the first elongated post section.

Finally, for adjustment between the aforesaid operating and transport position, each vertically adjustable post unit further preferably comprises an elongated threaded member disposed within the first and second post sections. The threaded member may be a rod or bar threadedly engaged with a transverse member affixed to the second post section. Selective rotation of the threaded bar or rod may be effectively utilized to vertically translate the second post section relative to the first post section, and thereby not only adjust the post units between the aforesaid operating and transport positions but also adjust the overall height of the dock deck. Thus the vertically adjustable post units with the threaded members provide for adjusting the height of the elongated deck relative to the support surface without requiring operator entry into the cold water to make the desired adjustment.

DESCRIPTION OF PREFERRED EMBODIMENTS

Figures 1, 2, 3:
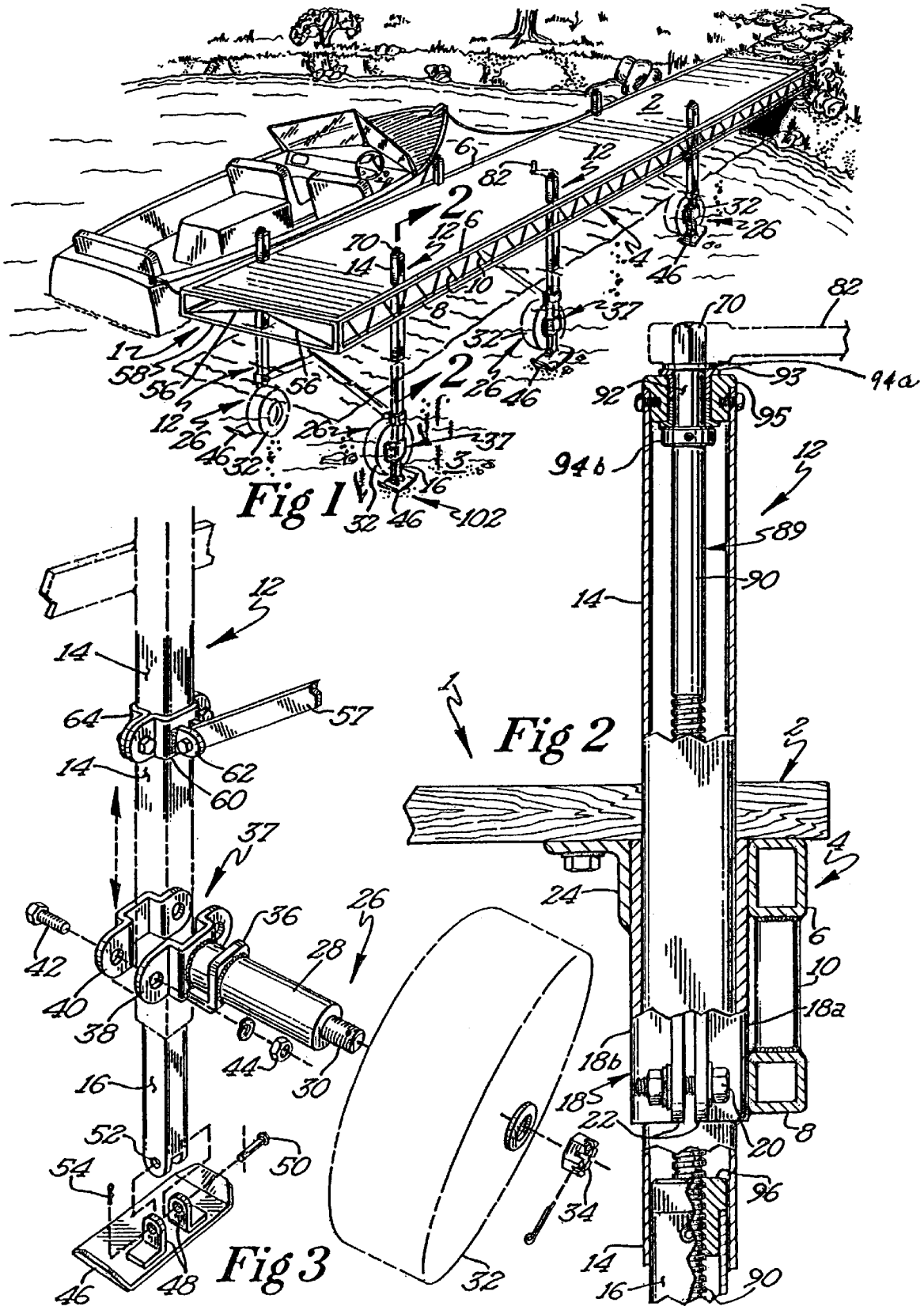
FIG. 1 is a perspective view of the dock of the invention shown in an operating position with the base pads resting on a water bed serving as a support surface and the wheels disposed inwardly from the post units and elevated off the support surface.
FIG. 2 is an enlarged, side elevational, section view of a portion of a vertically adjustable post unit taken along the lines 2—2 of FIG. 1.
FIG. 3 is an enlarged, exploded perspective view of a wheel assembly as mounted on a post unit.

With reference to FIG. 1 and 2, the dock of this invention is generally indicated by a dock structure having reference numeral 1 and is comprised of a dock deck 2 supported on a longitudinally extending supporting frame structure 4. The deck 2 may be made from plywood, deck boards or other suitable decking material as is well known in the art. The supporting frame structure 4 is comprised of elongated upper and lower beams 6 and 8 extending along opposite sides of the dock 1 so as to form a truss support having truss members 10 extending therebetween. The supporting frame structure 4 is further comprised of and strengthened by a plurality of transverse extension bars 56. Each extension bar 56 has one end secured to the median underside of the deck 2 and an other end rigidly attached to the lower beam 8. End frames 58 are secured across at the opposite ends of the dock structure 1. Each end frame 58 has an elongated topside and two truncated sides. The elongated topside of the end frame 58 is attached to the underside of the deck 2. Each of the two truncated sides of the end frame 58 is rigidly attached to the elongated upper and lower beams 6 and 8 extending along opposite sides of the dock 1 by any suitable means.

The dock structure 1 is supported by a plurality of vertically adjustable post units 12 mounted along the deck 2 at spaced locations on opposite sides thereof as shown in FIG. 1. For dock 1 height adjustment purposes as hereinafter set forth, each of the post units 12 is comprised of a first elongated post section illustrated as an outer tubular member 14 within which a second elongated post section, such as an inner tubular member 16, is telescopically received for relative vertical movement with respect thereto. Preferably, both outer and inner post sections 14 and 16 are made of square bar stock. Outer post section 14 is secured to the deck 2 for vertical support, and for raising and lowering the dock structure 1.

For those purposes, a guide sleeve 18 is secured to the frame structure 4 of the dock 1 at each of the post unit 12 locations adjacent to the underside of the deck 2. Outer elongated post member 14 extends upwardly through the guide sleeve 18 to a location above deck 2 as illustrated most clearly in FIGS. 1 and 2. Outer elongated post member 14 is rigidly affixed to the guide sleeve 18 such as by welding. Preferably, the guide sleeve 18 may be comprised of elongated first and second plates 18*a* and 18*b* which are fastened together around the outer post member 14 by bolts 20 extending through a clevis flange 22 on each of the first and second plates 18*a* and 18*b* as shown in FIG. 2. The first plate 18*a* is welded to truss beams 6 and 8; and the second plate 18*b* has a right angle bracket 24 attached thereto, as by welding, which is attached by fasteners to the underside of deck 2. The guide sleeve 18 thus bears against the underside of deck 2 and is rigidly attached to deck 2 by way of truss beams 6 and 8 and bracket 24.

For ease in moving the dock structure 1 into a shoreline position with the deck 2 extending out from the shoreline over the surface of the water in a lake or river, a wheel assembly 26 is secured to the lower end of the outer post member 14. As shown in FIG. 3, the wheel assembly 26 comprises an axle stub shaft 28 having a threaded extension 30. A wheel 32 is mounted on the stub shaft 28 and secured thereon by a wheel nut 34 threadedly attached to the threaded extension 30. The stub shaft 28 carries a flange 36 that bears against a hub plate of the wheel 32 so as to act as a stop and holding member for the wheel 32. The hub plate of the wheel 32 is drawn tightly against flange 36 by tightening wheel nut 34. The stub shaft 28 is affixed to the outer post member 14 by mating first and second brackets 38, 40. The first bracket 38 is affixed, as by welding, to the inner end of stub shaft 28. Bolts 42 extend through the apertured ears of the first and second brackets 38, 40 and tighten into place by a nut 44 to achieve a solid mounting of the wheel assemblies 26 on the outer post members 14.

As may be noted most clearly by reference to FIGS. 1 and 3, the inner post member 16 extends downwardly out of the outer post member 14 and has a base pad such as a base plate 46 attached to its bottom end. The base plate 46 is provided with a pair of upstanding, apertured bracket ears 48 which are attached to the bottom end of inner post member 16 by a cotter pin 50. The cotter pin 50 extends through the apertured bracket ears 48 and aligns through a hole 52 in the lower end of the inner post member 16. A spring clip 54 is used in a conventional manner to fasten the cotter pin 50 into place.

FIG. 2 illustrates one embodiment of a lift device 89 for the vertically adjustable post units 12. The lift device 89 is disposed primarily inside both the outer post member 14 and the inner post member 16 and preferably takes the form of an elongated threaded bar or rod 90. Threaded rod 90 extends vertically through the outer post member 14 and the inner post member 16 and is rotatably supported therein by a sleeve or bushing 93 and a threaded plug 96. Integral neck 92 of rod 90 extends through sleeve bushing 93 secured within top cap as at the upper end of outer post member 14. Spaced collars 94*a* and 94*b* affixed to the upper end of rod 90 bear against the top and bottom faces of sleeve 93 and restrain rod 90 against vertical displacement. Threaded member 96 is secured to the inner post member 16 and extends transversely thereof for supporting the threaded rod 90 for rotation with respect to the inner post member 16. Transverse member 96 may comprise a plug as shown having a threaded aperture for receiving the rotatable rod 90.

The lift device 89 is used for changing the height of the vertically adjustable post units 12 and thus the height of the elongated deck relative to the support surface 3 without the operator entering the water to make the adjustment. For that purpose a nut 70 is affixed to the top end of elongated rod 90 at an exposed, accessible position outside of post member 14.

To change the height of the dock structure 1 using the lift device 89, a wrench 82 turns the top nut 70. The top nut 70 is connected to and rotates the threaded rod 90, which imparts vertical movement to threaded cross member 96. Member 96 is attached to and vertically moves the inner post member 16. Thus, depending upon the clockwise (upward) or counter-clockwise (downward) rotation of threaded rod 90, the height of the vertically adjustable post units 12 and the height of the elongated deck 2 relative to the support surface 3 is adjusted upwardly or downwardly without the operator entering the water to make the adjustment.

A post brace 57 strengthens the post unit 12 connection to the dock structure 1. One end of the post brace 57 is rigidly secured to the median underside of the deck 2. As shown in FIG. 3, the other end of the post brace 57 is rigidly attached to the outer post member 14. This is preferably accomplished by the use of mating first and second brackets 60 and 64 that are secured around post member 14 and attached to each other by fasteners as shown in FIG. 3. The mating first bracket 60 carries a pair of clevis ears 62 to which the other end of the post brace 57 is attached by a fastener.

The wheels 32 and the base pads 46 are alternately utilized to transport and to support the dock structure 1 in a stable position of use. The relative elevations of the wheels 32 and the base pads 46 may be adjusted to permit rolling movement of the dock structure 1 into and out of a shore front use position with the wheels 32 on a support surface 3 such as a bed of water. Alternatively, the inner post members 16 may be vertically extended downwardly so as to rest on the support surface 3, such as a lake or river bottom, with the wheels 32 elevated so as to be out of contact with the support surface 3 as shown in FIG. 1.

Figure 4:
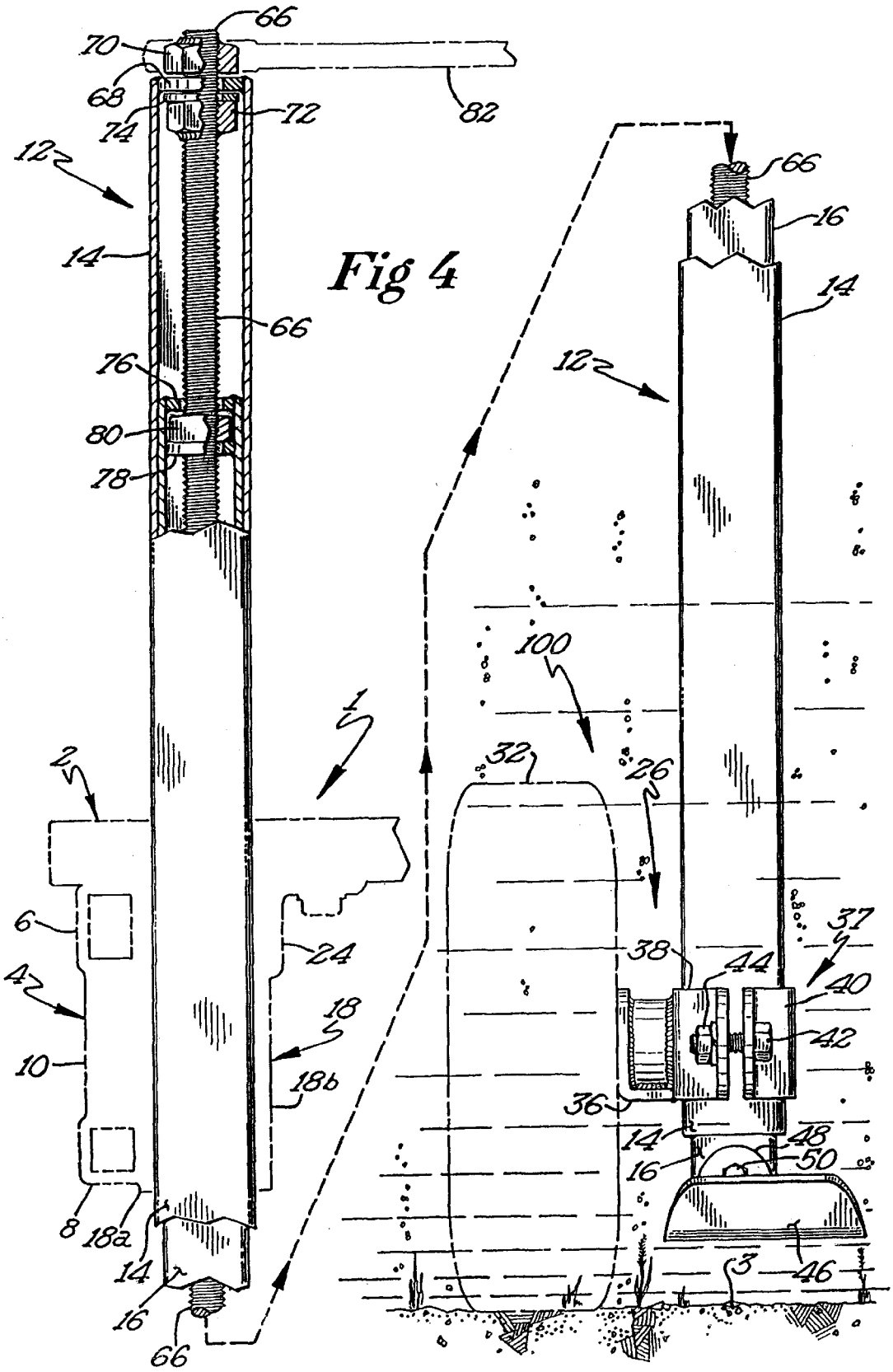
FIG. 4 is a front elevational view of the post unit and wheel combination in a transport position cutting away the midportion the post unit and showing the wheel disposed outwardly from the post unit in an alternative embodiment of the invention.

For the foregoing purposes as most clearly shown in FIG. 4, the vertically adjustable post units 12 in another embodiment of the invention comprise an elongated threaded rod 66 which is extended vertically through both of the post members 14 and 16. At its upper end, the rod 66 projects through the top cross plate 68 of the outer post member 14 and has a nut 70 welded thereto. A second nut 72 is welded to threaded rod 66 below top plate 68, with a shim washer 74 being positioned as shown between that nut and cross plate 68. Rod 66 is thus permitted to rotate about its longitudinal axis, but is restrained against vertical displacement. A plate 76 is also welded or otherwise secured across the upper end of inner post member 16, with a lower cross plate 78 being welded across post member 16 at a vertically spaced apart, lower location relative to plate 76. A transversely extending, threaded member in the form of a nut 80 is threadedly positioned on threaded rod 66 between plates 76 and 78.

After the dock structure 1 is assembled in the manner shown in FIG. 1 with the post units 12 mounted thereon, it is ready for installation at a lake or river shore. The dock structure 1 can be converted from its land storage position (not shown but similar to the operating position 102 shown in FIG. 1) with the base plate 46 on the ground and the wheel 32 elevated off the ground to its transport position 100 with the base plate 46 elevated off the ground and the wheel 32 on the ground as shown in FIG. 4. A wrench indicated by reference numeral 82 in FIGS. 1, 2, and 4 is used to rotate rod 66 or rod 90 by engagement with top nut 70. Turning top nut 70 counterclockwise lowers the dock structure 1 on the outer post member 14 so as to bring the wheels 32 down into engagement with the ground as shown in FIG. 4. As threaded rod 66 is rotated counterclockwise, nut 80, in threaded engagement therewith, is urged upwardly, against top plate 76. This produces a relative displacement force between inner post member 16 and outer post member 14 having the effect of lowering the outer post member 14 and the wheel 32 carried thereon. The rotation of top nut 70 is continued until the wheel 32 is lowered into contact with the ground, at which time base pads 46 will be elevated above the support surface 3, as shown in FIG. 4. The dock structure may then be moved into the water outwardly away from the shoreline utilizing the rolling action and support of the wheels 32.

Upon completing the transportation of the dock structure 1 to its water use location, the dock structure 1 can then be converted from its transport position with the base plates 46 elevated off the bed of water and the wheels 32 on the bed of water to its water use position as shown in FIG. 1 with the base plates 46 on the water bed 3 and the wheels 32 elevated off the water bed 3. The threaded rod 66 is rotated in the reverse, clockwise direction by the action of the wrench 82 on the top nut 70. This action urges the nut 80 in a downward direction against lower cross plate 78, thus forcing inner post member 16 downwardly. This rotational adjustment of threaded rod 66 is continued until the base plate 46 located on the bottom of the inner post member 16 is brought in contact with the support surface 3, namely the bed of a lake or river. Continued rotation of nut 70 in that same clockwise direction produces a reaction force on outer post member 14 in an upward direction, thereby lifting wheels 32 upwardly until they are raised above the bottom of the lake or river as shown in FIGS. 1 and 3. The adjustment nuts 70 on each of the multiple post units 12 are adjusted at this time until the deck or platform 2 is level at the desired height. A wrench 82 may be used in the same manner on nut 70 of threaded rod 90 as shown in the FIG. 2 embodiment to adjust post units 12 between the transport and operational use positions.

A particular advantage of being able to raise the wheels 32 after the dock structure 1 is in an operating position for use is that with base plates 46 resting on the support surface 3 in a lake or river bottom, a stable support is provided to the entire dock structure 1. If the dock structure 1 were left in the water with the wheels 32 on the support surface 3 as is frequently done, the dock structure 1 would not be totally stable. Because the tires 32 are inflated and also have some play on the stub shafts 28 on which the wheels 32 are mounted, there is a propensity for the dock structure 1 to sway as persons walk back and forth on deck 2. That problem is eliminated with the adjustable post units 12 incorporating the combination of a vertically adjustable wheel 32 and base plate 46 as disclosed herein.

It is to be noted, as shown in FIG. 4, that the stub shaft 28 of the wheel assembly 26 may be mounted to extend laterally outwardly rather than inwardly from the post unit 12. With such a mounting arrangement, the wheels 32 would be on the outside of the dock post units 12 rather than on the inside thereof as shown in FIGS. 1 and 3.

It is anticipated that various changes may be made in the structure of the dock 1 disclosed herein without departing from the spirit and scope of the invention as defined in the following claims. For example other types of lift mechanisms may be utilized to provide relative vertical movement between post sections 14 and 16 so as to achieve the relative height adjustment of wheels 32 and base pads 46.

What is claimed is:

1. A dock for supporting persons over a support surface comprising:

an elongated deck;

a plurality of vertically adjustable post units secured to the deck at spaced apart locations thereon for varying the height of said deck with respect to the support surface, each of the post units comprising:

a first elongated post section connected to said deck and having upper and lower ends;

a second elongated post section movably disposed with respect to the first elongated post section in a telescoping arrangement therewith;

a base pad connected to the second elongated post section; and a wheel rotatably connected to the lower end of the first elongated post section of each of the post units for transporting the dock across the support surface, whereby the post units can be vertically adjusted to position either the base pads or the wheels in contact with the support surface.

2. A dock as recited in claim 1, wherein said vertically adjustable post units are adjustable to a transport position, wherein the base pads are off the support surface and the wheels are on the support surface for transporting the dock.

3. A dock as recited in claim 1, wherein said vertically adjustable post units are adjustable to an operating position, wherein the base pads are on the support surface and the wheels are off the support surface for stabilizing the dock during normal use.

4. A dock as recited in claim 1 wherein said vertically adjustable post units are adjustable between an operating position in which the base pads are on the support surface with the wheels elevated above the support surface and a transport position in which the wheels are on the support surface with the base pads elevated above the support surface.

5. A dock as recited in claim 1 wherein the wheel on each post unit is secured to the first post section at a vertical location above the base pad.

6. A dock as recited in claim 1 wherein each of the wheels is rotatably mounted on an axle having a mounting bracket at one end, with the bracket being rigidly connected to the first elongated post section.

7. A dock as recited in claim 1 wherein:

an elongated, threaded member extends vertically within the first and second post sections of each post unit and is rotatably supported therein, said threaded member being threadedly engaged with a transverse member affixed to the second post section, whereby rotation of the elongated threaded member vertically translates the second post section with respect to the first post section to thereby achieve said vertical adjustment of the post units.

8. A dock as recited in claim 7 wherein the second post section is slidably movable within the first post section.

9. A dock as recited in claim 7 wherein:

the elongated threaded member has an upper end with a wrench connection thereon exposed outside of the post units, whereby the elongated threaded member may be rotated by a wrench to vertically adjust the post units.

10. The dock as recited in claim 1, wherein the wheel on each of the post units is disposed laterally outwardly from the first post section.

11. The dock as recited in claim 1, wherein the wheel on each of the post units is disposed inwardly from the first post section under the deck.

12. A dock for use over a water bed comprising:

an elongated deck having opposed sides;

a plurality of vertically adjustable post units secured to the opposed sides of the deck at spaced apart locations along the length of the deck to support the deck above a water bed and for varying the height of the deck with respect to the water bed comprising:

a first tubular section connected to said deck;

a second tubular section movably disposed within the first tubular section and having a lower end projecting therefrom;

a base pad connected to the lower end of the second tubular section; and a wheel assembly secured to the first tubular section of each of the post units, each of the wheel assemblies comprising a substantially horizontally extending axle on which a wheel is rotatably mounted for transporting the dock across the water bed; and said vertically adjustable post units being adjustable between an operating position having the base pads resting on the water bed and a transport position having the base pads elevated above the water bed with the wheels engaging the water bed for transporting the dock.

* * * * *